United States Patent [19]

Locke

[11] 4,403,528

[45] Sep. 13, 1983

[54] CROWN CAP REMOVING AND RETAINING IMPLEMENT

[75] Inventor: C. Joseph Locke, Lake Oswego, Oreg.

[73] Assignee: L-N International, Inc., Lake Oswego, Oreg.

[21] Appl. No.: 278,042

[22] Filed: Jun. 29, 1981

[51] Int. Cl.[3] ..... B67B 7/16; B67B 7/44

[52] U.S. Cl. ..... 81/3.46 R; 81/3.1 C

[58] Field of Search ..... 81/3.1 R, 3.1 B, 3.1 D, 81/3.1 C, 3.46 R, 125

[56] References Cited

U.S. PATENT DOCUMENTS

| | | | |
|---|---|---|---|
| Re. 23,731 | 11/1953 | Belpedio | 81/3.1 D |
| 2,641,397 | 6/1953 | Sander | 81/3.1 C |
| 2,801,557 | 8/1957 | Belpedio | 81/3.1 C |

*Primary Examiner*—Roscoe V. Parker

*Attorney, Agent, or Firm*—Kolisch, Hartwell & Dickinson

[57] ABSTRACT

An improved device for removing a crown cap from a bottle, retaining it in the device and subsequently reseating the cap on the bottle or releasing the cap for discard. Included is a rigid body having an elongate handle joined to a head formed with a cavity for receipt of a crown cap attached to a bottle. The head has an opening opposite the handle for engaging the rim of a cap during removal. An elongate leaf-spring member has an expanse substantially parallel to the handle with one end fixed to the handle. A distal end extends at an obtuse angle into the cavity. It terminates in a reverse bend away from the cavity. A push button attached to the member intermediate its ends extends through an opening in the handle for manually releasing a retained cap.

3 Claims, 5 Drawing Figures

CROWN CAP REMOVING AND RETAINING IMPLEMENT

BACKGROUND AND SUMMARY OF THE INVENTION

This invention pertains to a crown cap removing and retaining device and, more specifically, to such a device having a leaf-spring retainer for releasably retaining a crown cap.

Conventional devices provide a variety of ways for retaining removed caps within the opener and subsequently releasing same therefrom. Such devices are illustrated in two patents issued to Belpedio, No. Re. 23,731 for "Crown Cap Removing and Retaining Implement" and No. 2,801,557 for "Crown Cap Removing and Retaining Implement with Ejector". Crown caps are retained within the opener cavity by a pair of cooperating diametrically opposing clips which grasp a cap disposed therein or by a pair of downwardly projecting fingers opposite from an opening used to engage the cap rim during the opening process. In another embodiment, a single downwardly projecting finger is yieldably held in place against a cap disposed therein by a hairpin spring. Yet another embodiment includes an irregular loop formed from a metal band which extends into the cavity. Sufficient space exists inside the loop to receive a rod extending from the inside lower surface of the loop through the upper surface to a generally planar head. The rod head is interposed the upper loop portion and an ejector plate which extends into the top of the cap-receiving cavity. A push button is attached to the ejector plate over the rod head.

The ejector plate just described is used to remove a cap retained by the device after removal from a bottle by pressing down on the push button projecting through the handle. Alternative cap-releasing apparatus includes a knob for sliding cap-retaining clips away from the cap, as well as a hole in the top of the cap-retaining portion of the opener to allow the use of a finger to press the cap out of the device.

The type of device to which this invention pertains includes an elongate handle to which is attached an enlarged generally circular end having a skirt around it, all formed of a rigid material. The skirt portion opposite from the connection of the head to the handle typically has a slit configured for receipt of a cap rim for use in removing a cap from a bottle.

It is a general object of this invention to provide an improved bottle cap removing, retaining and releasing device which has fewer parts and is, therefore, easier and cheaper to manufacture.

It is a further object of the present invention to provide such a device which is easy, safe and convenient to use.

Specifically, it is an object to provide such a device in which a crown cap is retained by a single leaf-spring clip and release of such a cap is by direct application of a force against the clip to bend same away from the cap.

In the preferred embodiment of this invention, a single leaf-spring member having an expanse substantially parallel to the handle which is fixed at one end to the handle and has a free end which extends at an obtuse angle into the crown cap-receiving cavity for engaging a crown cap received therein. The extremity of the distal end has a reverse bend to provide a rounded surface for smooth engagement with cap and bottle surfaces as well as avoiding sharp edges which could cause injury to the user. A push button is attached to this member intermediate its ends and extends upwardly through the top of the handle where it is exposed for use. Thus, a substantially simplified cap retaining and releasing device is provided which satisfies the defined objectives.

These and additional objects and advantages of the present invention will be more clearly understood from a consideration of the drawings and the detailed description of the preferred embodiment.

DETAILED DESCRIPTION OF THE INVENTION

Figure 1:
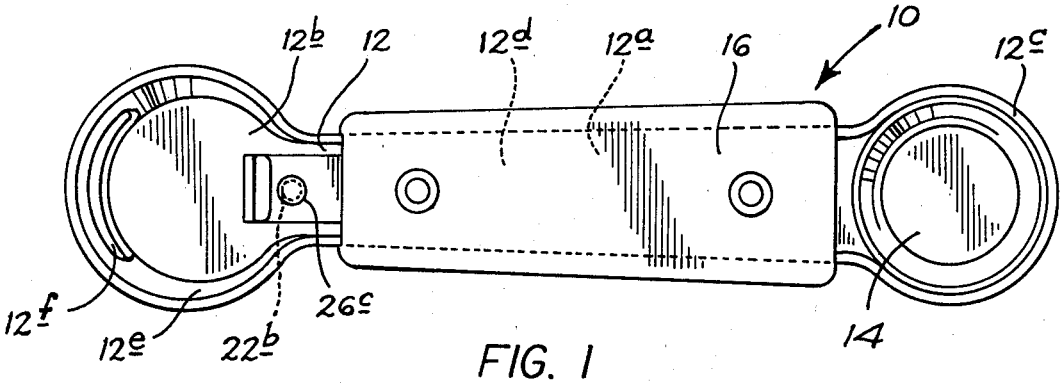
FIG. 1 is a bottom perspective view of the preferred embodiment of this invention.
Figure 2:
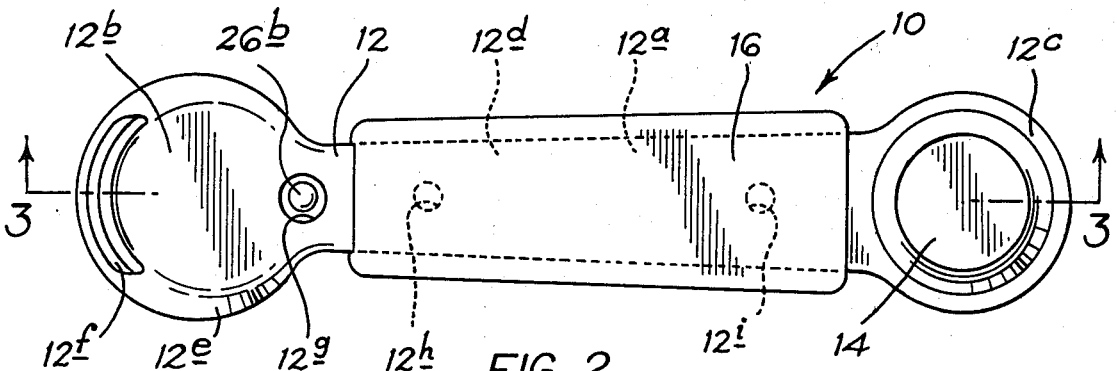
FIG. 2 is a top perspective view.
Figure 3:
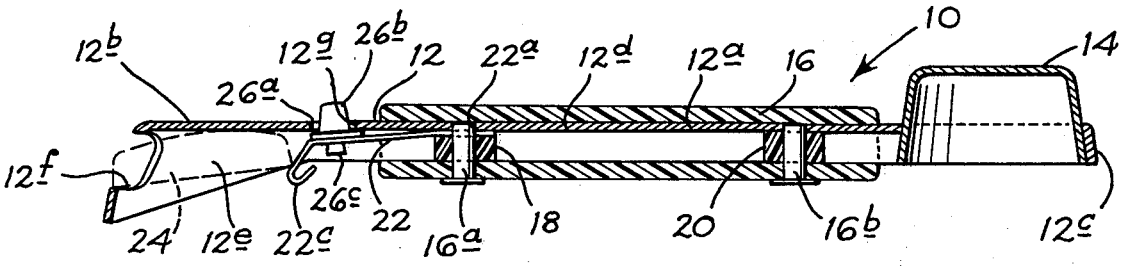
FIG. 3 is a cross-sectional view taken along line 3—3 in FIG. 2.

Referring initially to FIGS. 1, 2 and 3, a crown cap removing and retaining device made in accordance with this invention is shown generally at 10. Included is a rigid body 12 having an elongate handle portion **12*a*, a head or cap-receiving portion 12*b* joined to one end of handle 12*a*, and a cap-reseating portion 12*c* joined to the other end of handle 12*a*. The handle and head are formed from a unitary plate 12*d* which is generally normal to the viewing plane of FIGS. 1 and 2. A skirt or flange 12*e* depends from plate 12*d* around its perimeter and further extends in a loop from the end of handle 12*a* opposite the end which joins with the head, which loop forms part of cap-reseating portion 12*c*. A slot 12*f* sized to receive and engage a crown cap rim is disposed in skirt 12*e* on head 12*b* opposite from handle 12*a*. This opening is also referred to herein as cap-rim-engaging means. Head 12*b*, including associated portions of plate 12*d* and skirt 12*e*** are sized to form a cavity which will freely receive a crown cap.

Completing the cap-receiving portion is a tapered cylindrical cup 14 which is attached within the loop earlier described. This cup has an open end facing down, as shown in FIG. 3. Cup 14 has upwardly converging sides which are sized to allow free entry of a crown cap sealed on a bottle, but which provide a circumferentially snug fit to the rim of such a crown cap pressed against the closed end of cup 14.

Plate **12*d* has three transverse bores disposed therein. The first, bore 12*g* is disposed adjacent the joint connecting head 12*b* and handle 12*a*. Additionally, two more transverse bores 12*h*, 12*i* are disposed in spaced relationship on handle 12*d***.

A molded plastic handle cover 16 encloses handle **12*a*. Two pins 16*a*, 16*b* extend through bores 12*h*, 12*i*, respectively, joining the upper and lower portions of handle 16. A pair of sleeves 18, 20 surrounding pins 16*a*, 16*b*, respectively, have lengths equal to the distance between the inside of the lower section of handle 16 and the lower side of plate 12*d***.

A leaf-spring member 22, formed from an elongate metal strip, has a bore **22*a* at one end through which pin 16*a* extends. The expanse of member 22 having bore 22*a*** is disposed between sleeve 18 and plate 12*d*. It extends from pin 16*a* toward head 12*b* generally parallel with plate 12*d*. A distal end of the expanse extends downwardly at an obtuse angle into the cavity in head 12*b*. Disposed in this parallel expanse is a transverse hole 22*b* which is coaxial with bore 12*g*. The extremity of the distal end of member 22 has a reverse bend away from the cavity. This rounded bend 22*c* is disposed within the cavity of head 12*b* such that a crown cap disposed therein is engaged by member 22, as is illustrated by the position of a crown cap 24 shown in phantom lines in FIG. 3.

A push button or push button means 26 is mounted on the leaf spring. Such includes a collar 26*a* which rests against the leaf-spring end and is of larger diameter than bore 22*b*. The push button further includes a nipple 26*c* of larger diameter than bore 22*b* which abutts the opposite side of the leaf spring and which is connected to the collar through a stem (not shown) which passes through bore 22*b*. The push button further includes a knob 26*b* extending upwardly from the collar freely through bore 12*g*. Preferably, collar 26*a* has a larger diameter than bore 12*g*.

Figure 4:
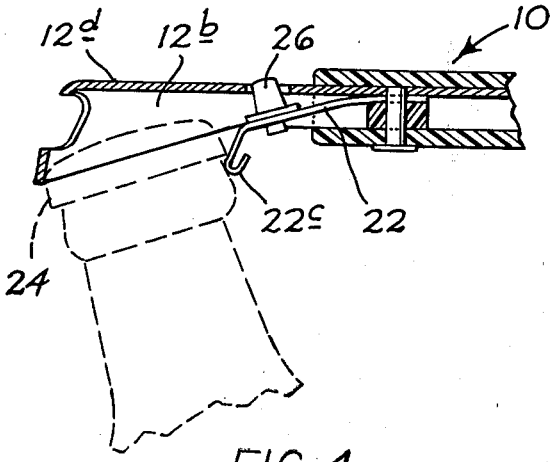
FIG. 4 is a fragmentary cross-sectional view showing one way of inserting a bottle top and cap into the device.

Explaining operation and use of device 10 and referring initially to FIG. 4, the preferred method of engaging a crown cap seated on a bottle is to insert the cap at an angle directed toward member 22 as shown. As the cap and bottle are forced into the cavity in head 12*b* the resilience of member 22 acting in conjunction with rounded end 22*c* allows end 22*c* to slide over the surface of the cap and bottle until the cap rim is engaged by the lower edge of slot 12*f*. The final position of cap 24 after insertion is shown in FIG. 3.

Figure 5:
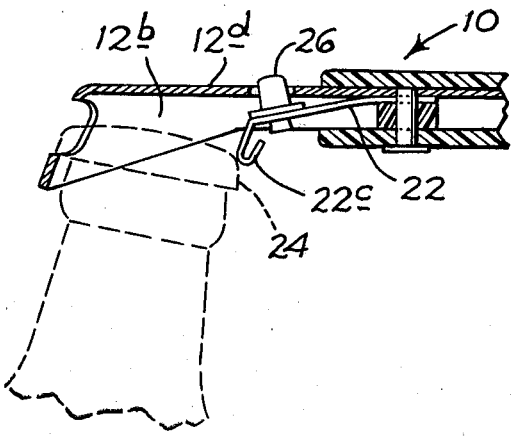
FIG. 5 is similar to FIG. 4 except that a second way of introducing the bottle cap into the device is shown.

An alternate method of introducing cap 24 into the cavity of head 12*b* is illustrated in FIG. 5. With this method, the cap rim is first inserted into opening 12*f* and the bottle pivoted until the cap top opposite from the opening engages plate 12*d*. In this process, rounded member end 22*c* slides over the curved top edge of cap 24, slightly springing member 22. Again the final position of cap 24 is shown in FIG. 3.

With the cap rim engaged by the lower edge of slot 12*f*, a downward force is applied on handle 16 causing the cap to become disengaged from the bottle. Because of the engagement of the cap rim with member 22, the cap is retained inside the cavity of head 12*b*. If it is desired to reseat cap 24 on the bottle, it is placed on the top of the bottle while retained in head 12*b*. A downward directed force on plate 12*d* of head 12*b* temporarily reseats the cap on the bottle. The device is removed from the cap following steps opposite from those just described for inserting the cap into the device. It may be facilitated by pressing down on button 26 which presses tip 22*c* away from the cap, allowing it to be freely released.

If a more effective reseating is desired, cup 14 is placed over the cap temporarily seated on the bottle. A heavy downward force is then applied, preferably with a slight lateral turn to reseal the crown cap on the bottle.

If after a cap has been removed from a bottle, it is desired to dispose of the bottle cap, this may be done simply by holding the device as shown in FIG. 3 and pressing button 26. As described previously, this releases member 22 from engagement with cap 24 allowing it to fall from the device. After removal of the cap, the button is released so that member 22 may resume its original position for reuse.

It can be seen that the device contemplated by this invention, as illustrated in the foregoing description of the preferred embodiment, is effective for retaining crown caps for subsequent use or allowing their release. This is provided by a novel leaf-spring member directly attached to a push button which is simple and cheap to manufacture and safe and easy to use.

While the invention has been particularly shown and described with reference to the foregoing preferred embodiment, it will be understood by those skilled in the art that other changes in form and detail may be made therein without departing from the spirit and scope of the invention as defined in the following claims.

It is claimed and desired to secure by Letters Patent:

1. A crown cap removing and retaining device comprising a rigid body having an elongate handle portion and a cap-receiving portion joined to one end of said handle portion, said cap-receiving portion having a cavity for receiving a cap and cap-rim-engaging means disposed opposite from said handle portion, an elongate unitary leaf-spring member cooperating with said cap-receiving portion to releasably hold a removed cap in said cap-receiving portion by engaging the underside of the rim of the cap, said leaf-spring member having an elongate expanse substantially paralleling said handle portion which expanse terminates in one end which is fixed to said handle portion, said leaf-spring member further including a distal end portion joined to the opposite end of said expanse extending at an obtuse angle from said expanse into said cavity for holding engagement with the underside of the rim of a cap disposed in said cap-receiving portion, the extremity of said distal end portion being formed in a reverse bend away from said cavity, said expanse progressing outwardly from said fixed end being resiliently flexible away from said handle portion and flexing of said expanse producing movement of said distal end portion in an arcuate path extending away from said handle portion and away from said cap-rim-engaging means, movement in said arcuate path producing release of a cap, and push button means for flexing said expanse, said body having a transverse bore disposed adjacent where the handle and cap-receiving portions join, said push button means comprising a knob attached to said expanse of said leaf-spring member, said knob extending through said bore and being depressible to flex said expanse away from said handle portion thus to produce movement of said distal end portion in said arcuate path.

2. The device of claim 1, wherein said leaf-spring member has a hole extending through its said expanse and said push button means includes a nipple partially received by said hole.

3. The device of claim 2, wherein said push button means further has a collar interposed said knob and nipple having an outer dimension larger than said bore and hole.

* * * * *